US009521915B1

(12) United States Patent
Tanger et al.

(10) Patent No.: US 9,521,915 B1
(45) Date of Patent: Dec. 20, 2016

(54) APPARATUS FOR SUSPENDING OBJECT ON A WALL

(71) Applicants: Jonathan P Tanger, Plantation, FL (US); Davina C Lochan, Plantation, FL (US)

(72) Inventors: Jonathan P Tanger, Plantation, FL (US); Davina C Lochan, Plantation, FL (US)

( * ) Notice: Subject to any disclaimer, the term of this patent is extended or adjusted under 35 U.S.C. 154(b) by 0 days.

(21) Appl. No.: 14/924,646

(22) Filed: Oct. 27, 2015

(51) Int. Cl.
*A47F 7/14* (2006.01)
*A47G 1/16* (2006.01)

(52) U.S. Cl.
CPC ..... *A47G 1/1606* (2013.01)

(58) Field of Classification Search
CPC ..... A47G 1/1606; A47K 10/10
See application file for complete search history.

(56) References Cited

U.S. PATENT DOCUMENTS

D506,125 S * 6/2005 Munson ..... D8/373
8,371,543 B2 * 2/2013 Schneider ..... F16M 13/02 248/224.8
2002/0125389 A1 * 9/2002 Chu ..... A47B 96/027 248/235
2007/0023595 A1 * 2/2007 Harmsen ..... A47G 1/1606 248/227.2
2009/0050775 A1 * 2/2009 Constantinou ..... A47G 1/1606 248/489

* cited by examiner

*Primary Examiner* — Amy Sterling
(74) *Attorney, Agent, or Firm* — Gulf Coast Intellectual Property Group

(57) ABSTRACT

An apparatus operable to provide hanging of an object on a vertical wall such as but not limited to an open back canvas. The apparatus includes a wall member and a frame member. The wall member includes a lower portion and an upper portion contiguously formed. The upper portion is configured to angularly extend away from a wall subsequent mounting the wall member thereto. The upper portion of the wall member includes a first leg member and a second leg member with a channel intermediate thereto. The frame member includes an upper surface operable to support an object thereon. A lip is formed along the rear perimeter edge of the upper surface. The frame member includes an upper portion having an angular perimeter edge. Contiguously formed with the upper portion is an arm that is configured to extend downward therefrom. The arm is inserted into the channel.

13 Claims, 4 Drawing Sheets

APPARATUS FOR SUSPENDING OBJECT ON A WALL

FIELD OF THE INVENTION

The present invention relates generally to devices operable to hang an object on a wall, more specifically but not by way of limitation an apparatus configured to suspend an open back canvas or art board either with or without a frame wherein the apparatus of the present invention includes a wall member and a frame member.

BACKGROUND

Millions of homeowners regularly decorate the interior of the rooms of their homes. Interior design is known to include numerous elements and some exemplary decorative elements are paintings and pictures. As is known in the art paintings and pictures are typically framed works of art with the former many times being applied to a canvas or similar item having an open back design. Regular use of conventional picture hangers is common and as is not in the art a conventional picture hanger includes a member secured to a wall that has a portion operable to receive therein a wire or other similar object that is mounted across the back of the picture or painting desired to be hung on the wall. Numerous other types of fasteners have been developed and are utilized to provide a technique for hanging an object on a wall.

One problem with existing hanging devices is their inability to couple with the object being hung in a manner that promotes a parallel engagement. The conventional wire hanging method typically leaves the object being hung at a downward angle, which can detract from the presentation as well as introduce undesirable shear forces, which can result in damage to the wall or the falling of the object. Additionally, many current hanging devices do not promote an even load distribution across the apparatus. Uneven load distribution can result in the failure of the device or damage to the wall. Another issue with current hanging devices is their inability to control lateral movement, or turning of the article being hung on the wall. Whether during the hanging process or subsequent installation any turning motion can cause a failure and result in the falling of the object or increase the complexity of installation.

Accordingly, there is a need for a hanging apparatus that is operable to hang an object on a wall that includes a frame portion and a wall portion wherein the hanging apparatus is operable to provide an even load distribution and alignment with the article being hung so as to inhibit any turning movement.

SUMMARY OF THE INVENTION

It is the object of the present invention to provide an apparatus operable to hang an object on a wall wherein the apparatus includes a frame member operable to be coupled to the object and a wall member operable to be secured to a wall wherein the frame member and wall member are mateably engagable.

Another object of the present invention is to provide an apparatus operable to hang an object on a wall wherein the frame member includes body having an upper surface that is operable to facilitate a parallel coupling of the frame member to the rear of a conventional frame.

A further object of the present invention is to provide an apparatus for hanging an object on a wall such as but not limited to a painting wherein the frame member further includes an alignment lip extending upward from the upper surface wherein the alignment lip is operable to engage a portion of a frame and promote alignment therewith.

An additional object of the present invention is to provide an apparatus for hanging an object on a wall such as but not limited to a open back canvas wherein the body of the frame member includes an angular portion wherein the angular portion further includes a plurality of apertures operable to receive fasteners therethrough so as to engage a portion of the frame of the open back canvas.

Still another object of the present invention is to provide an apparatus for hanging an object on a wall operable to promote even load distribution wherein the frame member further includes a leg member, the leg member formed with and extending downward therefrom from the angular portion.

Yet another object of the present invention is to provide an apparatus for hanging an object on a wall wherein the wall member includes a lower portion and an upper portion with the lower portion being configured to be parallel to a wall subsequent fastening thereto.

An additional object of the present invention is to provide an apparatus for hanging an object on a wall having a mateable frame member and a wall member wherein the wall member further includes an upper portion being angular with respect to the lower portion so as to extend away from a wall ensuing the securing of the wall member to a wall.

An added object of the present invention is to provide an apparatus for hanging an object on a wall wherein the upper portion of the wall member includes a first leg member and a second leg member having a channel intermediate thereto that is operable to receive therein the leg member of the frame member.

An additional object of the present invention is to provide an apparatus for hanging an object on a wall wherein the leg member of the frame member is further configured with a plurality of releasable fasteners or the like so as to promote increased coupling security with the wall member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
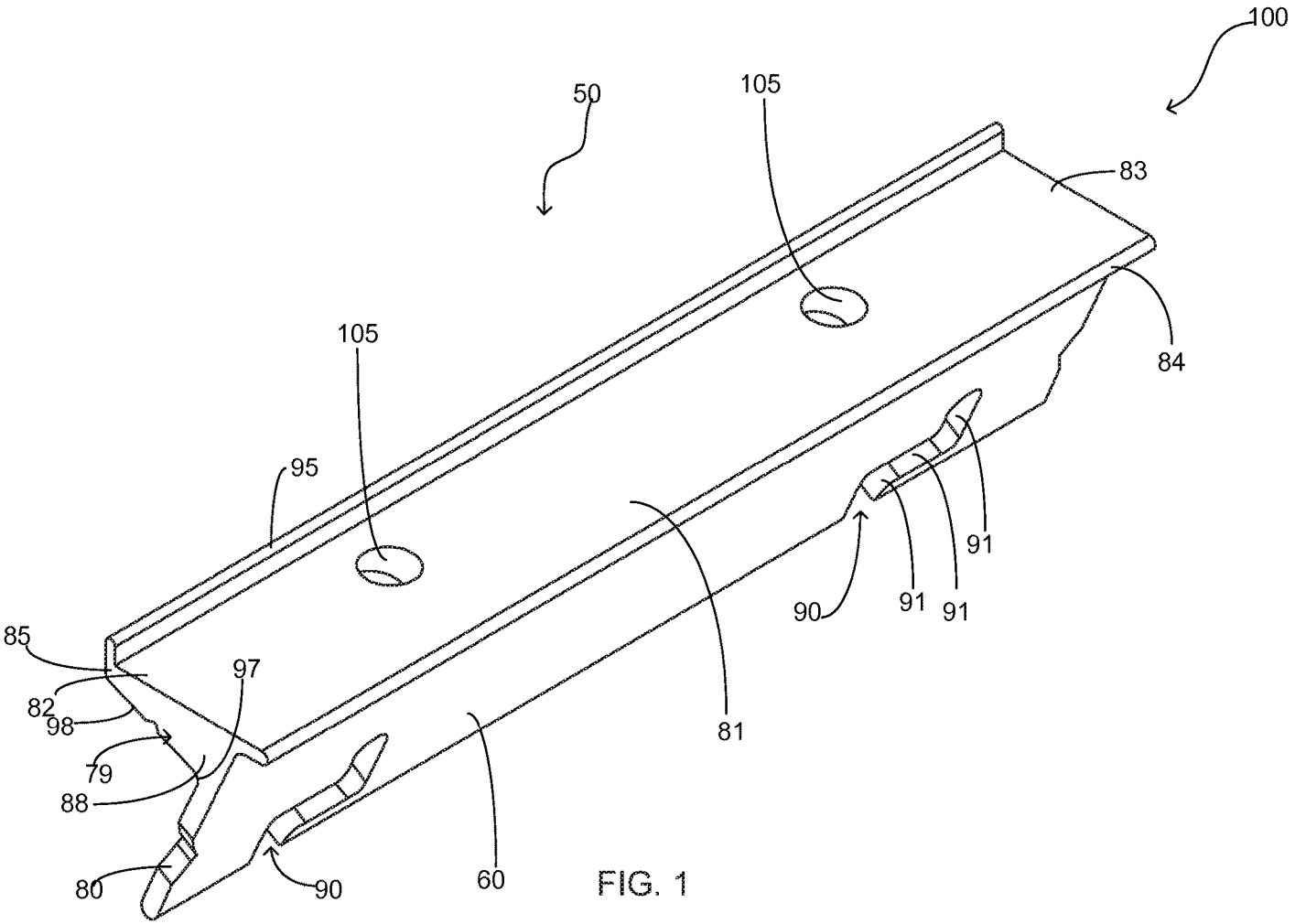
FIG. 1 is a perspective view of the frame member of the present invention.

Referring now to the drawings submitted herewith, wherein various elements depicted therein are not necessarily drawn to scale and wherein through the views and figures like elements are referenced with identical reference numerals, there is illustrated hanging apparatus 100 constructed according to the principles of the present invention.

Figure 2:
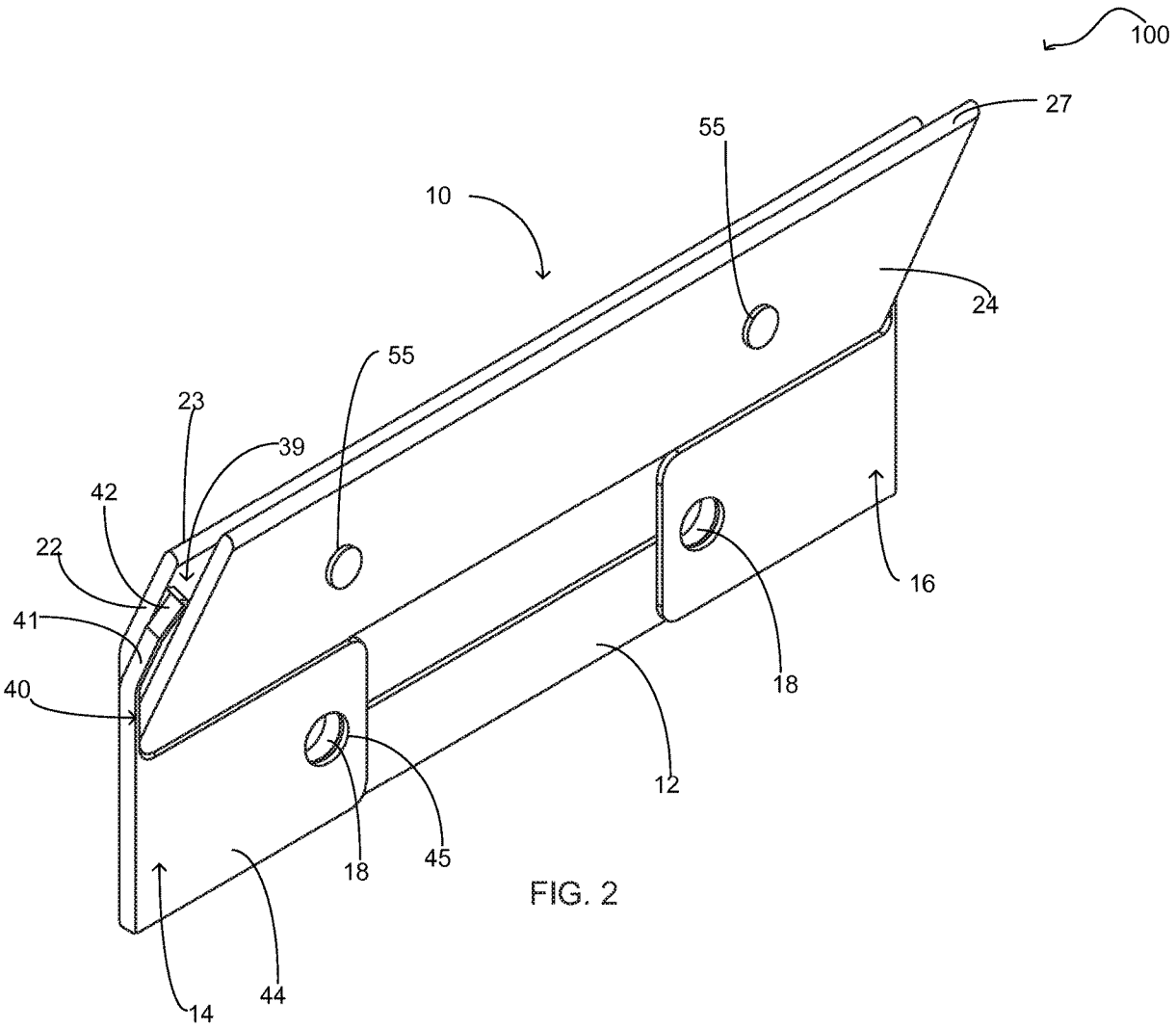
FIG. 2 is a perspective view of the wall member of the present invention.
Figure 3:
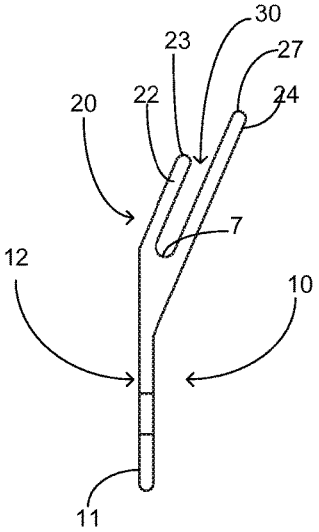
FIG. 3 is a side view of the wall member of the present invention.

Referring in particular to FIG. 2 and FIG. 3 herein, the hanging apparatus 100 includes wall member 10. Wall member 10 is manufactured from a suitable durable material such as but not limited to metal. The wall member 10 is operable to be secured to a wall such as but not limited to the interior surface of a wall within a home. The wall member 10 includes a lower portion 12 that is planar in manner having first end 14 and second end 16. The lower portion 12 includes apertures 18 that are of suitable size so as to accommodate a conventional fastener such as but not limited to a screw so as to secure the wall member 10 to a wall. While two apertures 18 are illustrated herein, it is contemplated within the scope of the present invention that the wall member 10 could have numerous different amounts of apertures 18 in order to accommodate various load requirements.

Contiguously formed with the lower portion 12 is upper portion 20. Upper portion 20 is angularly oriented with lower portion 12. Surface 11 of the lower portion 12 is flat and is adjacent a wall subsequent the installation of the wall member 10 to a wall. The upper portion 20 is angularly formed with the lower portion 12 such that the upper portion 20 extends away from a wall ensuing the mounting of the wall member 10. The upper portion 20 includes a first leg member 22 and a second leg member 24. First leg member 22 and second leg member 24 are planar in manner and extend intermediate the first end 14 and second end 16. Intermediate the first leg member 22 and second leg member 24 is channel 30. Channel 30 is operable to receive therein arm 60 of the frame member 50 as further discussed herein. The first leg member 22 and second leg member 24 are formed so as to be parallel creating a channel 30 having a consistent width. First leg member 22 includes upper edge 23 and second leg member 24 includes upper edge 27. The upper portion 20 is manufactured such that the second leg member 24 is greater in length than the first leg member 22 wherein the upper edge 27 is greater in height the upper edge 23. This formation facilitates improved receipt of arm 60 as further discussed herein. While no particular width of the channel 30 is required, good results have been achieved having a channel 30 that is between 0.005 inches and 0.020 inches wider than the thickness of arm 60. The aforementioned range of width of the channel 30 promotes engagement with the arm 60 that is substantially void of any undesirable movement such as but not limited to turning.

Referring in particular to FIG. 2 herein, the wall member 10 further includes locking tab 40. The locking tab 40 is manufactured from a resilient metal or other suitable resilient material. Locking tab 40 includes arm 41 having end 42 that is aligned with channel 30 and is operable to extend inward thereinto. The arm 41 is resilient in manner such that the arm 41 is movable between a first position and a second position. In its second position, the arm 41 is biased away from the end 39 of channel 30 so as to allow arm 60 of the frame member 50 to be inserted into the channel 30. In its first position, the resilient arm 41 is biased against the arm 60 of the frame member 50 subsequent the arm 60 being inserted into the channel 30. The end 42 is configured so as to be mateably shaped with the notch 80 of the arm 60. End 42 maintains a biased engagement with notch 80 subsequent insertion of the arm 60 into channel 30. This biased engagement promotes a secure connection between the wall member 10 and frame member 50 so as to inhibit any movement therebetween. The locking tab 40 further includes lower body portion 44 that is mounted adjacent to the lower portion 10 and integrally formed with arm 41. Lower body portion 44 includes aperture 45 that is configured to align with aperture 18 ensuing the locking tab 40 being placed in position for use. It is contemplated within the scope of the present invention that the wall member 10 could include two locking tabs 40 being secured to first end 14 and second 16. Additionally, it is contemplated within the scope of the present invention that the wall member 10 have no locking tabs 40.

Still referring in particular to FIG. 2, the upper portion 20 of the wall member 10 includes mounting pins 55. Mounting pins 55 are manufactured from a suitable durable rigid material and are secured to the upper portion 20 wherein the mounting pins 55 extend across channel 30 and are secured to the first leg member 22 and second leg member 24 utilizing suitable techniques. Mounting pins 55 are operable to engage slots 90 as further discussed herein. While two mounting pins 55 are illustrated herein, it is contemplated within the scope of the present invention that the upper portion 20 of the wall member 10 could have any number of mounting pins 55 and further be provided with no mounting pins 55.

Figure 4:
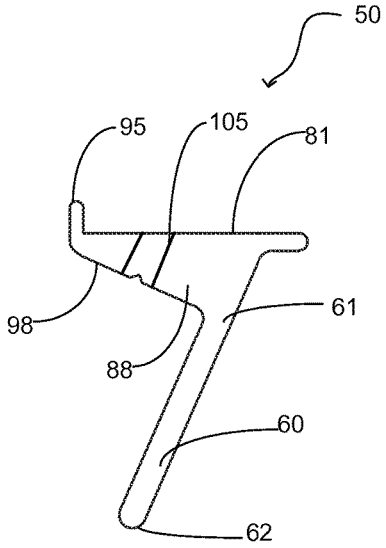
FIG. 4 is a side view of the frame member of the present invention.

Referring now to FIG. 1 and FIG. 4 herein, the hanging apparatus 100 further includes frame member 50. Frame member 50 is configured to be releasably secured to an object desired to be hung on a wall. More specifically but not by way of limitation, the frame member 50 is operable to be secured to the frame portion of a conventional framed canvas. The frame member 50 includes body 79 having an upper surface 81. The upper surface 81 is planar in manner and functions to have superposed thereon a portion of the object desired to be hung on a wall. The upper surface 81 is rectangular in shape having a first end 82 and second end 83 and a forward perimeter edge 84. Opposite the forward perimeter edge 84 is rear perimeter edge 85. Integrally formed with the upper surface 81 proximate the rear perimeter edge 85 is lip 95. Lip 95 is perpendicular with upper surface 81 and extends upward therefrom. While no particular thickness of the lip 95 is required, good results have been achieved utilizing a lip 95 that is 0.030 inches in thickness. The aforementioned thickness promotes placement of an object being hung with the hanging apparatus 100 to be placed as close to the wall as possible. The lip 95 functions to ensure a mounting to the object that is square and parallel in manner. By way of example but not limitation, as the frame member 50 is engaged with a conventional open back canvas frame portion the upper surface 81 is placed adjacent to the bottom surface of the frame portion of the conventional open back canvas. Continuation of placement proceeds with the lip 95 being placed adjacent to the rear side of the frame of the conventional open back canvas. The aforementioned placement ensures a square and parallel securing of the frame member 50.

The frame member 50 includes upper portion 88 that is integrally formed with the upper surface 81 and lip 95. Upper portion 88 is underneath upper surface 81 and includes perimeter edge 98. Perimeter edge 98 extends from adjacent lip 95 to end 97 proximate arm 60. Upper portion 88 is angular in construction such that the thickness thereof proximate arm 60 is greater than that of the thickness proximate lip 95. The aforementioned construction provides a perimeter edge 98 that is angular in orientation with respect to the upper surface 81. The angular orientation of the perimeter edge 98 is operable to ensure that the frame member 50 is secured to an article for hanging so as to substantially inhibit any vertical shear forces acting on fasteners journaled through apertures 105. Apertures 105 are bored through the upper portion 88 utilizing suitable techniques. The angular orientation of the perimeter edge 98 ensures that the lip 95 is pulled against the article to which the frame member 50 is being secured to during the process of tightening the fastener, by way of example a conventional screw. This ensures a square mounting of the frame member 50 to an object and further ensures that the frame member 50 will engage the wall member 10 such that the load distribution will extend the length of the frame member 50. The angular orientation of perimeter edge 98 further provides an improved access to a screw or other fastener being journaled through aperture 105 during fastening of the frame member 50 to an object. The angular orientation of the perimeter edge 98 directs the head of the screw or fastener journaled through aperture 105 away from an object thereby reducing the probability of a user's tool or hand contacting and potentially damaging the object.

Frame member 50 further includes arm 60. Arm 60 is contiguously formed with the upper portion 88 and extends downward therefrom. Arm 60 includes first end 61 and second end 62 and is further constructed to have a consistent thickness intermediate first end 61 and second end 62. The arm 60 is angular with respect to the upper surface 81. The angular orientation of the arm 60 is mateable so as to facilitate engagement with channel 30 during hanging of an object. While no particular angular orientation of the arm 60 is required, good results have been achieved manufacturing a frame member 50 wherein the angle of the arm 60 with respect to the upper surface 81 is between 100 and 160 degrees. It is further contemplated within the scope of the present invention that the arm 60 could be manufactured in various different lengths but in its preferred embodiment the arm 60 is manufactured having a length operable to engage the bottom 7 of channel 30.

As shown in particular in FIG. 1, arm 60 further includes slots 90. Slots 90 are operable to engage mounting pins 55 in order to facilitate an improved secure coupling of the frame member 50 to the wall member 10. Slots 90 include a plurality of portions 91 that are perpendicular to each other wherein the arrangement of the portions 91 function to provide a captive securing of the mounting pins 55. It is contemplated within the scope of the present invention that the slots 90 could be configured with various quantities of portions 91 in order to provide the desired functionality as described herein. Furthermore, while two slots 90 are illustrated herein, it is contemplated within the scope of the present invention that the arm 60 could be manufactured with no slots 90 or various quantities thereof.

Figure 5:
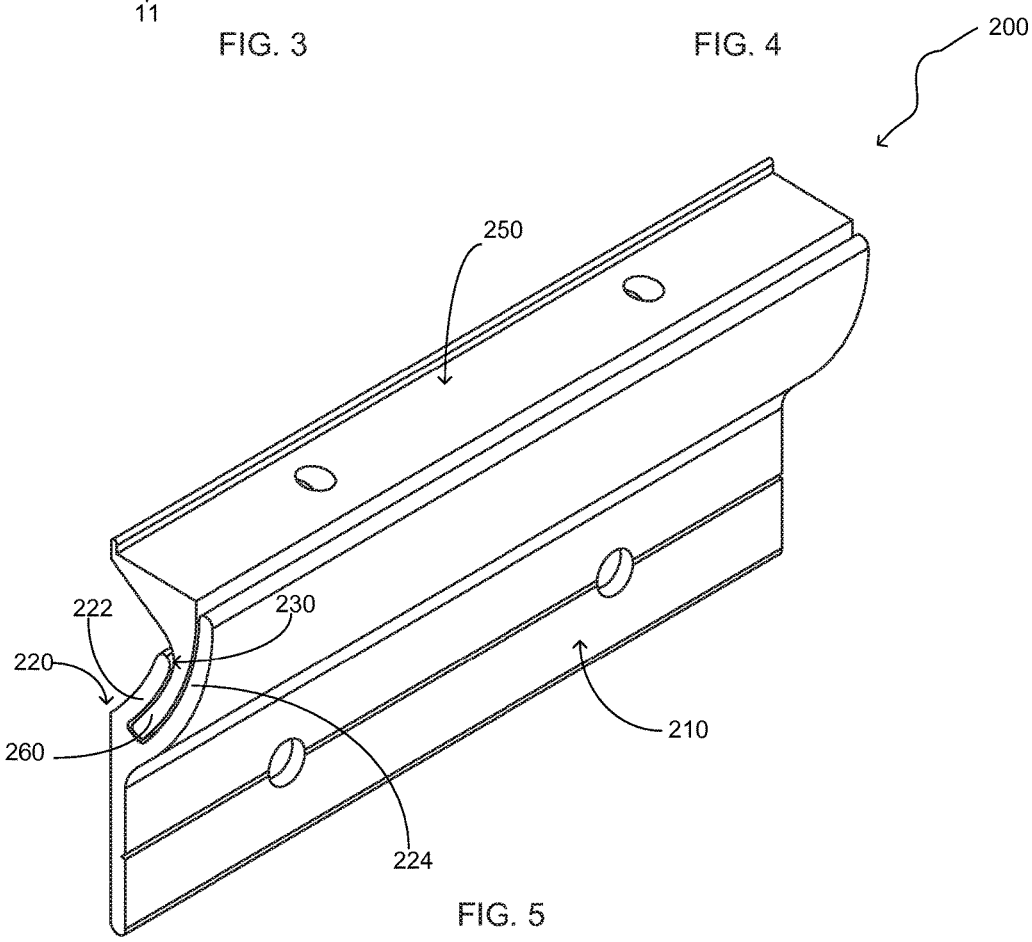
FIG. 5 is a perspective view of an alternative embodiment of the present invention.

Referring in particular to FIG. 5 herein an alternative embodiment of the hanging apparatus 200 is illustrated therein. The hanging apparatus 200 is constructed similarly to hanging apparatus 100 with the following exceptions. Upper portion 220 of the wall member 210 includes leg member 222 and leg member 224 having a channel 230 intermediate thereto. The leg member 222 and leg member 224 are arcuate in shape so as to create a channel 230 having a radius. The frame member 250 includes integrally formed arm 260 wherein the arm 260 is manufactured having a radius that is equivalent to the radius of the channel 230.

Additionally, while not illustrated herein, it is contemplated that the arm 60 and at least a portion of the upper portion 20 could be magnetic so as to increase the security of the coupling of the frame member 50 to the wall member 10.

Figure 6:
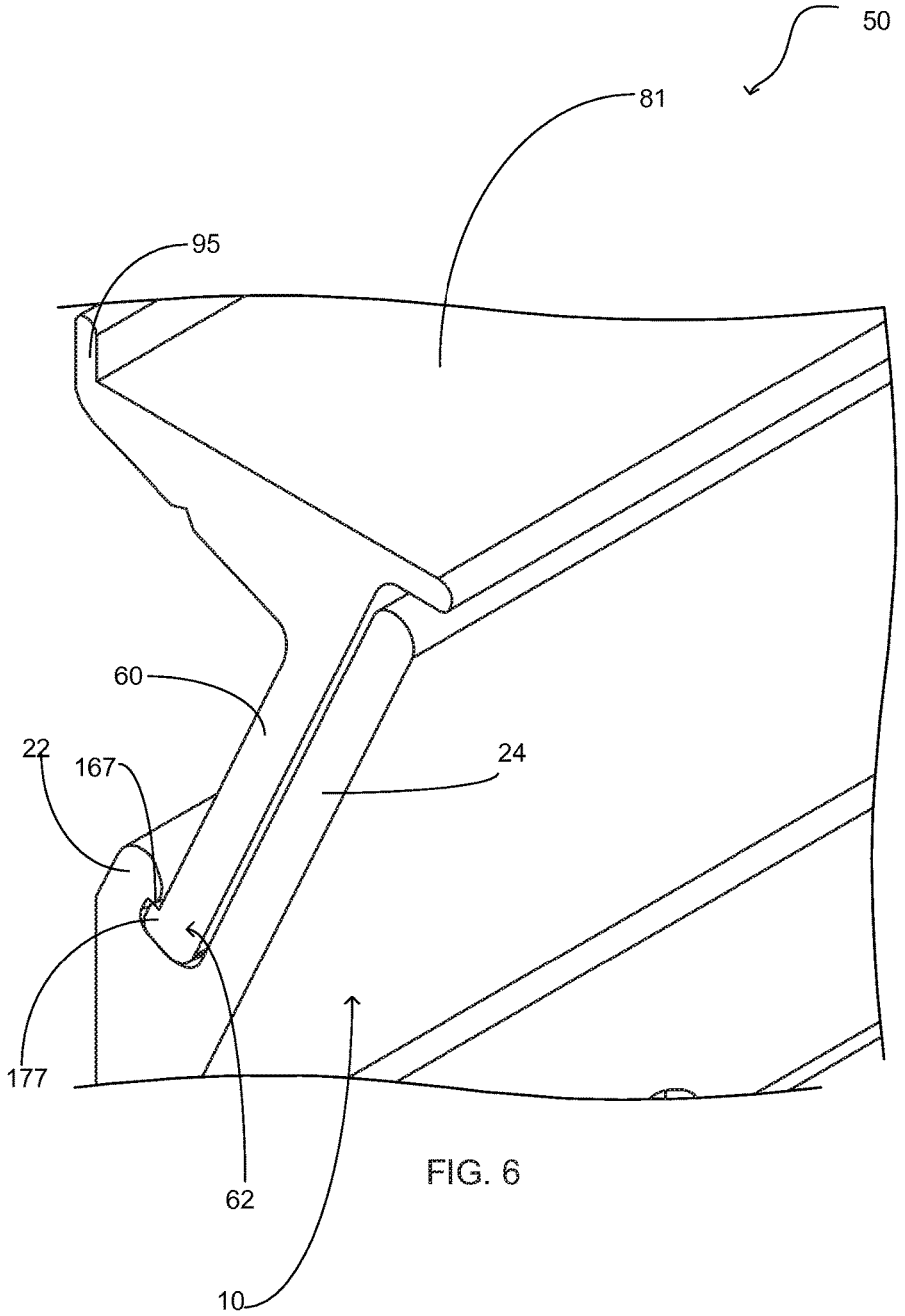
FIG. 6 is a side view of an alternative configuration of the frame member arm and first leg member of the wall member of the present invention.

Referring in particular to FIG. 6 herein, an alternative configuration of the arm 60 and the first leg member 22 are illustrated therein. In this alternative configuration the first leg member 22 is substantially shorter in length than the second leg member 24. The first leg member 22 includes upper protrusion 167 wherein the upper protrusion 167 is configured to extend the length of the first leg member 22 and is further configured to project inward towards the second leg member 24. Arm 60 includes outcrop member 177 integrally formed on second end 62 thereof. Outcrop member 177 is configured to extend outward toward first leg member 22 and engage with the upper protrusion 167 as illustrated herein. This aforementioned configuration is operable to provide a technique to further enhance the connection intermediate the wall member 10 and frame member 50. It is contemplated within the scope of the present invention that the upper protrusion 167 and outcrop member 177 could be formed in various sizes and numerous angles and still achieve the desired functionality as described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An apparatus operable to suspend an object on a vertical wall comprising:

a wall member, said wall member having a lower portion and an upper portion contiguously formed, said upper portion being angular with respect to said lower portion wherein said upper portion is configured to extend away from a wall subsequent the wall member being secured thereto, said upper portion of said wall member having a first leg member and a second leg member, said upper portion further including a channel intermediate said first leg member and said second leg member;

a frame member, said frame member configured to be operably coupled to an object desired to be suspended on a vertical wall, said frame member including an upper surface, said upper surface being planar in manner, said upper surface being rectangular in shape, said frame member further including a lip extending upward therefrom, said lip operable to promote square engagement with an object, said frame member further including an upper portion, said upper portion being underneath and contiguous with said upper surface, said upper portion having a perimeter edge that is angular in manner, said frame member further including an arm, said arm being contiguously formed with said upper portion and extending downward therefrom;

at least one aperture, said at least one aperture being bored through said frame member, said at least one aperture being bored through said frame member in an angular manner with respect to said upper surface, wherein said aperture is operable to receive a fastener therethrough so as to facilitate the securing of the frame member to an object; and wherein said arm is configured to be inserted into said channel during mounting of an object to a wall on which the wall member has been secured.

2. The apparatus operable to suspend an object on a vertical wall as recited in claim 1, wherein said lower portion of said wall member further includes at least one aperture journaled therethrough so as to facilitate the attachment to a wall with a fastener.

3. The apparatus operable to suspend an object on a vertical wall as recited in claim 2, wherein said upper surface of said frame member includes a forward perimeter edge and a rear perimeter edge, said lip being formed along said rear perimeter edge and extending perpendicularly upward therefrom.

4. The apparatus operable to suspend an object on a vertical wall as recited in claim 3, wherein said second leg member is distal to a wall on which the wall member is attached and wherein said second leg member is longer than said first leg member.

5. The apparatus operable to suspend an object on a vertical wall as recited in claim 4, wherein said arm is angular in manner with respect to said upper surface within the range of 100 to 160 degrees.

6. The apparatus operable to suspend an object on a vertical wall as recited in claim 5, wherein said channel is configured to be greater in width than said arm by a range of 0.005 inches to 0.020 inches.

7. An apparatus operable to assist in the hanging of an object against a vertical wall comprising:

a wall member, said wall member having a first end and a second end, said wall member having a lower portion and an upper portion contiguously formed, said lower portion being planar in manner and rectangular in shape, said upper portion being angular with respect to said lower portion wherein said upper portion is configured to extend away from a wall subsequent the wall member being secured thereto, said upper portion of said wall member having a first leg member and a second leg member, said first leg member having an upper edge, said second leg member having an upper edge, said upper portion further including a channel intermediate said first leg member and said second leg member, said lower portion of said wall member further including a plurality of apertures;

a frame member, said frame member configured to be operably coupled to an object desired to be suspended on a vertical wall, said frame member having a first end and a second end, said frame member including an upper surface, said upper surface being planar in manner, said upper surface being rectangular in shape, said upper surface having a forward perimeter edge and a rear perimeter edge, said upper surface being horizontal in orientation so as to receive a portion of the object superposed thereon, said frame member further including a lip, said lip being formed along said rear perimeter edge of said upper surface, said lip extending upward from said upper surface and being perpendicular thereto, said lip operable to promote square engagement with an object, said frame member further including an upper portion, said upper portion being underneath and contiguous with said upper surface, said upper portion having a perimeter edge that is angular in manner, said frame member further including an arm, said arm being contiguously formed with said upper portion and extending downward therefrom, said arm being angular in manner with respect to said upper surface;

at least one aperture, said at least one aperture being bored through said frame member, said at least one aperture being bored through said frame member in an angular manner with respect to said upper surface, wherein said aperture is operable to receive a fastener therethrough so as to facilitate the securing of the frame member to an object; and wherein said arm is configured to be inserted into said channel during mounting of an object to a wall on which the wall member has been secured.

8. The apparatus operable to assist in the hanging of an object against a vertical wall as recited in claim 7, wherein said upper portion of said frame member further includes a plurality of apertures journaled therethrough, said plurality of apertures configured to receive conventional fasteners so as to secure the frame member to an object for hanging.

9. The apparatus operable to assist in the hanging of an object against a vertical wall as recited in claim 8, wherein the perimeter edge of said upper portion of said frame member extends intermediate said rear perimeter edge of said upper surface to said arm.

10. The apparatus operable to assist in the hanging of an object against a vertical wall as recited in claim 9, wherein said upper edge of said second leg member is greater in height than said upper edge of said first leg member.

11. The apparatus operable to assist in the hanging of an object against a vertical wall as recited in claim 10, wherein said channel is configured to be greater in width than said arm by a range of 0.005 inches to 0.020 inches.

12. The apparatus operable to assist in the hanging of an object against a vertical wall as recited in claim 11, wherein said arm is angular in manner with respect to said upper surface within the range of 100 to 160 degrees.

13. The apparatus operable to assist in the hanging of an object against a vertical wall as recited in claim 12, wherein said lip is approximately 0.030 inches in thickness.

* * * * *